US007695552B2

(12) United States Patent
Sato et al.

(10) Patent No.: US 7,695,552 B2
(45) Date of Patent: Apr. 13, 2010

(54) IONIZER

(75) Inventors: Toshio Sato, Tsukubamirai (JP); Gen Tsuchiya, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 254 days.

(21) Appl. No.: 12/015,010

(22) Filed: Jan. 16, 2008

(65) Prior Publication Data

US 2008/0190294 A1 Aug. 14, 2008

(30) Foreign Application Priority Data

Feb. 14, 2007 (JP) ..... 2007-034017

(51) Int. Cl.
*B03C 3/41* (2006.01)

(52) U.S. Cl. ..... 96/83; 96/97; 313/230; 313/238

(58) Field of Classification Search ..... 96/43, 96/50, 83, 84, 94, 97; 313/230, 238, 243; 361/225–235
See application file for complete search history.

(56) References Cited

U.S. PATENT DOCUMENTS 1,995,790 A * 3/1935 Anderson ..... 96/64
2,209,798 A * 7/1940 Subkow ..... 208/350
2,381,578 A * 8/1945 Dillon et al. ..... 95/57
3,156,847 A * 11/1964 Schweriner ..... 361/230
3,195,819 A * 7/1965 Watanabe ..... 239/601
3,206,625 A * 9/1965 Stuetzer ..... 310/309
3,476,095 A * 11/1969 De Laubarede ..... 123/536
3,768,258 A * 10/1973 Smith et al. ..... 60/275
3,879,986 A * 4/1975 Sehmel ..... 73/28.04
3,957,374 A * 5/1976 Kriese et al. ..... 356/312
4,391,614 A * 7/1983 Rozmus ..... 95/28
4,477,263 A * 10/1984 Shaver et al. ..... 95/7
4,741,746 A * 5/1988 Chao et al. ..... 96/43
5,149,339 A * 9/1992 Collins, Jr. ..... 95/70
5,217,510 A * 6/1993 Logan et al. ..... 96/15
5,518,531 A * 5/1996 Joannu ..... 96/55

(Continued)

FOREIGN PATENT DOCUMENTS

JP 56-78645 A * 6/1981 ..... 96/97

(Continued)

OTHER PUBLICATIONS

U.S. Appl. No. 11/877,269, filed Oct. 23, 2007, Sato, et al.

*Primary Examiner*—Richard L Chiesa
(74) *Attorney, Agent, or Firm*—Oblon, Spivak, McClelland, Maier & Neustadt, L.L.P.

(57) ABSTRACT

In an ionizer composed of an electrode needle cartridge and a main body block, the electrode needle cartridge is provided with an electrode needle for generating an ion, a high voltage generating device for applying high voltage to the electrode needle, and a receiving connector for connecting a feeding connector, and the main body block is provided with an air-blowing outlet serving as an electrode needle housing portion, an air passing-through hole for supplying air to the air-blowing outlet, and a connecting port for connecting an air piping. The electrode needle cartridge is configured such that when the electrode needle cartridge and the main body block are connected or separated, the electrode needle is inserted into or removed from the air-blowing outlet from a rear end portion side of the air-blowing outlet.

12 Claims, 6 Drawing Sheets

U.S. PATENT DOCUMENTS

| | | | | |
|---|---|---|---|---|
| 5,667,563 | A * | 9/1997 | Silva, Jr. | 96/50 |
| 6,004,375 | A * | 12/1999 | Gutsch et al. | 95/57 |
| 6,464,754 | B1 * | 10/2002 | Ford | 95/26 |
| 6,506,232 | B2 * | 1/2003 | Menear | 95/59 |
| 6,635,105 | B2 * | 10/2003 | Ahlborn et al. | 96/28 |
| 7,115,153 | B2 * | 10/2006 | Ahlborn et al. | 95/74 |
| 7,465,340 | B2 * | 12/2008 | Sato et al. | 96/83 |
| 7,497,898 | B2 * | 3/2009 | Sato et al. | 96/43 |
| 2006/0278081 | A1 * | 12/2006 | Han et al. | 96/61 |
| 2007/0034082 | A1 * | 2/2007 | Adair et al. | 96/63 |
| 2007/0126363 | A1 | 6/2007 | Sato et al. | |

FOREIGN PATENT DOCUMENTS

| | | |
|---|---|---|
| JP | 2004-228069 | 8/2004 |

* cited by examiner

IONIZER

TECHNICAL FIELD

The present invention relates to an ionizer for use in a discharge for various kinds of electrostatically charged workpieces.

BACKGROUND ART

In a treating process for various types of workpiece such as a semiconductor wafer, liquid crystal glass, or the like, an ionizer is used for discharging the workpiece, which is electrostatically charged. The ionizer is constructed such that a corona discharge is generated by applying a positive and negative high voltage to an electrode needle, and that static electricity is neutralized by spraying a then-generated positive ion and a negative ion with air.

In this kind of ionizer, the electrode needle tends to have a stain due to adhesion of dust or the like, and when the adhesion of the stain proceeds, a generating amount of the ion is being reduced because the corona discharge gradually becomes difficult to be generated. Therefore, there is a possibility that the generation of the ions is finally stopped. Therefore, this requires maintenance such as a cleaning operation, an exchanging operation, and so forth for the electrode needle in each time when the electrode needle has the stain. In order to perform the complicated maintenance, as simply and safely as possible, it is important that the electrode needle is configured to be detached from a housing portion simply and safely.

In the Japanese Unexamined Patent Application Publication No. 2004-228069, an ionizer where an electrode needle unit is configured to be detachable from a main body case is disclosed as an ionizer in which maintenance for a discharge needle (electrode needle) can simply be performed. This ionizer is configured such that a nozzle provided with an air-blowing outlet serving as an ion-generating chamber is provided in the main body case. The ionizer is further configured such that a printed circuit board where a high voltage generating circuit for applying a high voltage to the electrode needle is mounted in the main body case, and that the electrode needle unit is configured to be detachable from a rear side of the nozzle in the ion generating chamber of the nozzle. By this construction, when the electrode needle has the stain, the cleaning operation and the exchanging operation for the electrode needle can be performed by detaching the electrode needle unit from the nozzle.

However, since the ionizer described in the Patent Document is formed with all of electricity-relating parts or portions such as a printed circuit board where the high voltage generating circuit is mounted, a connector therefor, and so forth, air-relating parts or portions such as an air communication hole, connecting port for use in piping, and so forth, in the main body case in a built-in manner, a structure of the main body case tends to be complicated and large-sized at the same time, depending on a structure for disposing and electrically insulating the each of the parts or portions, or the like. Further, since it is necessary to form a structure for connecting or cutting out the electrode needle to the high voltage generating circuit in a built-in manner, when detaching the electrode needle unit, the structure therefor has been also complicated.

DISCLOSURE OF INVENTION

Accordingly, an object of the present invention is to provide an ionizer provided with a rational design structure, where electricity-relating parts and portions, such as an electrode needle, a high voltage generating device, and so forth, and air-relating parts and portions, such as a nozzle, an air-communication hole, a connecting port for use in piping, and so forth are provided while dividing the same into separate members, and thereby facilitating a disposition therefor and simplifying a structure thereof. At the same time, the object of the present invention is to provide an ionizer where attaching and detaching operations for the electrode needle are thereby enabled to be performed in a simple and safe manner.

So as to achieve the object, the present invention is characterized in that an ionizer is constructed by separatably connecting an electrode needle cartridge including an electrode needle for generating an ion, and a main body block including an air-blowing outlet serving as an electrode needle housing chamber in a condition where the electrode needle is inserted into the air-blowing outlet, and that in the ionizer constructed such that the electrode needle is inserted into or removed from the air-blowing outlet from an electrode needle inserting entrance at a rear end portion side of the air-blowing outlet, when the electrode needle cartridge and the main body block are connected or separated, the electrode needle cartridge is provided with the detachable electrode needle and a high voltage generating device for applying high voltage to the electrode needle, and the main body block is provided with an air passing-through hole for supplying air to the air-blowing outlet and a connecting port for connecting an air piping to the air passing-through hole.

In the present invention, it is preferable that the ionizer is constructed such that the electrode needle cartridge is connected to or separated from the main body block, and the electrode needle is inserted into or removed from the air-blowing outlet by only sliding the electrode needle cartridge in a front-and-back direction without rotating the same.

Further, in the present invention, it is preferable that a convex step portion and a concave step portion, which are in contact with each other, are formed at a front end portion of the main body block and a front end portion of the electrode needle cartridge, respectively, and the air-blowing outlet is formed at a position of the convex step portion and the electrode needle is formed at a position of the concave step portion.

More preferably, the main body block includes a base portion provided with the air-blowing outlet, the air passing-through hole, and the connecting port, and a cartridge housing portion for housing the electrode needle cartridge while being positioned on the base portion, and at an upper surface of a tip end portion of the base portion, the convex step portion rising upward is formed, and at a front surface of the convex step portion, the air-blowing outlet is provided, and at a rear surface of the convex step portion, the electrode needle inserting entrance is provided in a concentric manner relative to the air-blowing outlet. Further, the electrode needle cartridge has a length in a front-and-back direction approximating to the main body block, and includes the concave step portion conforming to the convex step portion at a lower surface of a tip end portion. The electrode needle is attached to a position of the concave step portion in a condition of extending forward, and the electrode needle cartridge is configured to be attached to and detached from the main body block by sliding in the front-and-back direction along an upper surface of the base portion as a guide.

In the present invention, the electrode needle may detachably and elastically be held by a conductive electrode needle holder having elasticity, and the electrode needle holder may be detachably and elastically attached to a column-shaped feeding terminal protruding outward from a housing of the electrode needle cartridge.

Alternatively, it may be constructed that the electrode needle inserting entrance is composed of a large diameter portion at an entrance side, and a small diameter portion at a rear side and the electrode needle holder includes a flange-shaped contacting portion at a base end portion. Furthermore, it may be constructed that a diameter of the contacting portion is formed to be greater than a bore diameter of the small diameter portion, and when the electrode needle held by the electrode needle holder is inserted into the air-blowing outlet from the electrode needle inserting entrance, frontward movement of the electrode needle holder is configured to be limited by that the contacting portion is in contact with and hooked on a mouth edge of the small diameter portion.

Further, in the present invention, more preferably, the ionizer includes a locking member for locking the electrode needle cartridge and the main body block in a connected condition, and the locking member is configured to limit an operation for releasing a locking operation in a condition where the high voltage generating device is connected to a power source.

It is more preferable that, the electrode needle cartridge includes a receiving connector for connecting the feeding connector attached to a power cable, and that the locking member includes a main shaft portion rotatably supported by the electrode needle cartridge, a hooking portion hooked on and tripped from the main body block by forward-and reverse rotation of the main shaft portion, and a handle portion for performing a rotating operation for the main shaft portion. Further, it is also more preferable that when the feeding connector is connected to the receiving connector, a rotation of the handle portion in a direction where the locking operation is released is configured to be limited by means of the feeding connector by that the handle portion is disposed in the vicinity of the connecting port of the receiving connector.

In the ionizer according to the present invention, the electrode needle cartridge is provided with the electrode needle and the high voltage generating device, and the main body block is provided with the air-blowing outlet, the air passing-through hole, and the connecting port. Thereby, the electricity-relating parts and portions, and the air-relating parts and portions can rationally be distributed into separate members, and supported. As a result, above-described heretofore known problems are solved. Further, an entire construction can be simplified, and at the same time, the attaching and detaching operations for the electrode needle can be performed simply and safely.

BEST MODE FOR CARRYING OUT THE INVENTION

Figure 1:
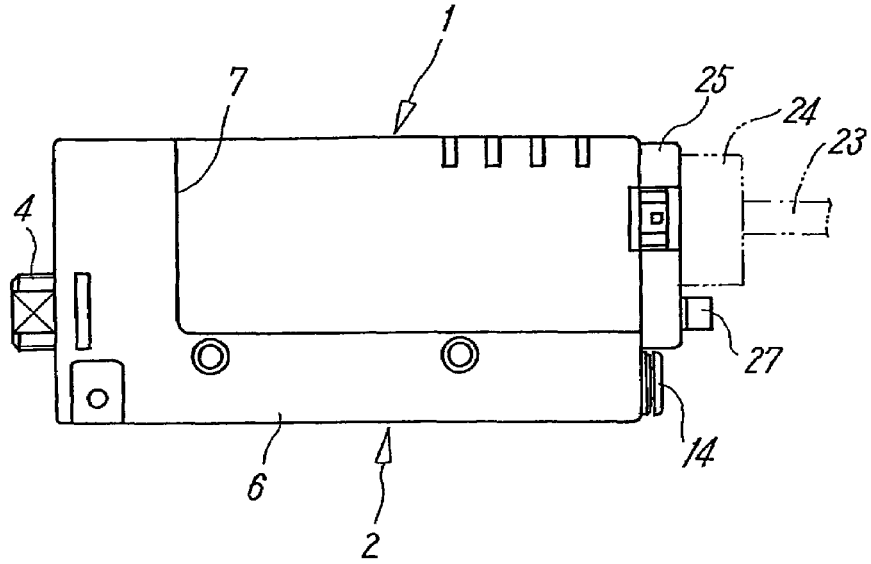
FIG. 1 is a side elevation illustrating an embodiment of an ionizer according to the present invention.
Figure 2:
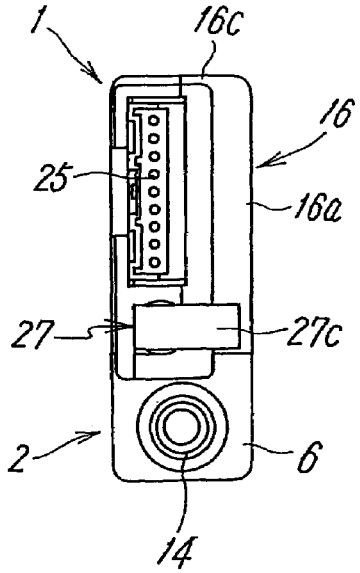
FIG. 2 is a rear side elevation illustrating the ionizer in FIG. 1.

FIG. 1 through FIG. 11 are views illustrating an embodiment of an ionizer according to the present invention. The ionizer is an ionizer of an alternating current (AC) type where AC high voltage is applied to an electrode needle so that an ion is generated, and is composed of an electrode needle cartridge 1 provided with an electrode needle 3 for generating the ion, and a main body block 2 provided with a nozzle 4 for blowing out air ionized by the ion generated by means of the electrode needle 3, to a workpiece.

The main body block 2 is made of an electrical insulation material such as synthetic resin or the like. Further, as is clearly understood from FIG. 4, the main body block 2 includes a base portion 6 extending in a front-and-back direction at a lower half portion of the main body block 2 in an elongated manner, and a cartridge housing portion 7 that houses the electrode needle cartridge 1, while being partitioned and formed above the base portion 6, and is formed into a long rectangular outer shape in the front-and-back direction, looking from a side.

At a tip end portion of the base portion 6, a convex step portion 8 rising upward is formed, and an upper surface 6*a* of the base portion 6 is formed into a substantially flat surface without having an asperity in the front-and-back direction of the base portion 6*b* including an upper surface of this convex step portion 8.

At a front end surface of the base portion 6, the nozzle 4 having a cylindrical shape, for blowing out air is attached at a position corresponding to the convex step portion 8. The nozzle 4 is made of an electrically conductive material, and serves as a ground electrode for earthing. The nozzle 4 is inserted into a nozzle attaching hole 5 formed in the base portion 6, and fixed thereto with a hooking clamp 4*a*. The nozzle 4 is connected to an earthing portion, not shown, provided in the main body block 2. In an inside of the nozzle 4, a round shaped air-blowing outlet 9 serving as an electrode needle housing chamber is provided. In addition, a sleeve 10 having an electrical insulation is attached in a manner so as to surround an inner periphery of the air-blowing outlet 9. Further, at a rear end surface of the convex step portion 8, an electrode needle inserting entrance 11 for the electrode needle 3 to be inserted into or removed from the air-blowing outlet 9 of the nozzle 4 is provided in a concentric manner relative to the air-blowing outlet 9. The electrode needle inserting entrance 11 is composed of a large-diameter portion 11*a* at an entrance side and a small-diameter portion 11*b* at a back side.

At a position between the nozzle 4 and the small-diameter portion 11*b* of the electrode needle inserting entrance 11, an air passing-through hole 12 that is allowed to communicate with the air-blowing outlet 9 is formed. The air passing-through hole 12 is once extended downward from a position between the nozzle 4 and the electrode needle inserting entrance 11, and is thereafter bent sideways and extended backward inside the base portion 6. The air passing-through hole 12 is allowed to communicate with a connecting port 13 for use in an air piping that is formed at a rear end portion of the base portion 6. To the connecting port 13, a pipe joint 14 of a simple connection type is attached, and by only plugging a piping tube into the pipe joint 14, the piping tube is configured to be connected in a retaining manner.

Accordingly, when pressure air is supplied into the air passing-through hole 12 from the piping tube, the air is blown out toward the workpiece from the air-blowing outlet 9 of the nozzle 4.

The cartridge housing portion 7 includes a side surface cover 16. As is clear from FIG. 2 and FIG. 4, the side surface cover 16 is composed of a side wall portion 16*a* that covers a side surface of one side of the cartridge housing portion 7, a front wall portion 16*b* that covers a front surface, and an upper wall portion 16*c* that covers part of an upper surface. Portions of the side surface cover 16 corresponding to a side surface of the other side of the cartridge housing portion 7, and a rear surface thereof are open. Further, the electrode needle cartridge 1 is mounted on the upper surface 6*a* of the base portion 6, and is slid forward along the upper surface 6*a* as a guide in a non-rotating condition, and is fitted inside the side surface cover 16. Thereby, electrode needle cartridge 1 is housed in the cartridge housing portion 7 and connected to the main body block 2. When the electrode needle cartridge 1 is separated from the main body block 2, it is sufficient that an operation opposite to the above-described operation, which is performed when the electrode needle cartridge 1 is connected to the main body block 2, is performed.

When the ionizer is assembled by connecting the electrode needle cartridge 1 with the main body block 2 as described above, an entire shape of the ionizer is formed to be a rectangular block shape by the electrode needle cartridge 1 and the main body block 2.

Figure 3:
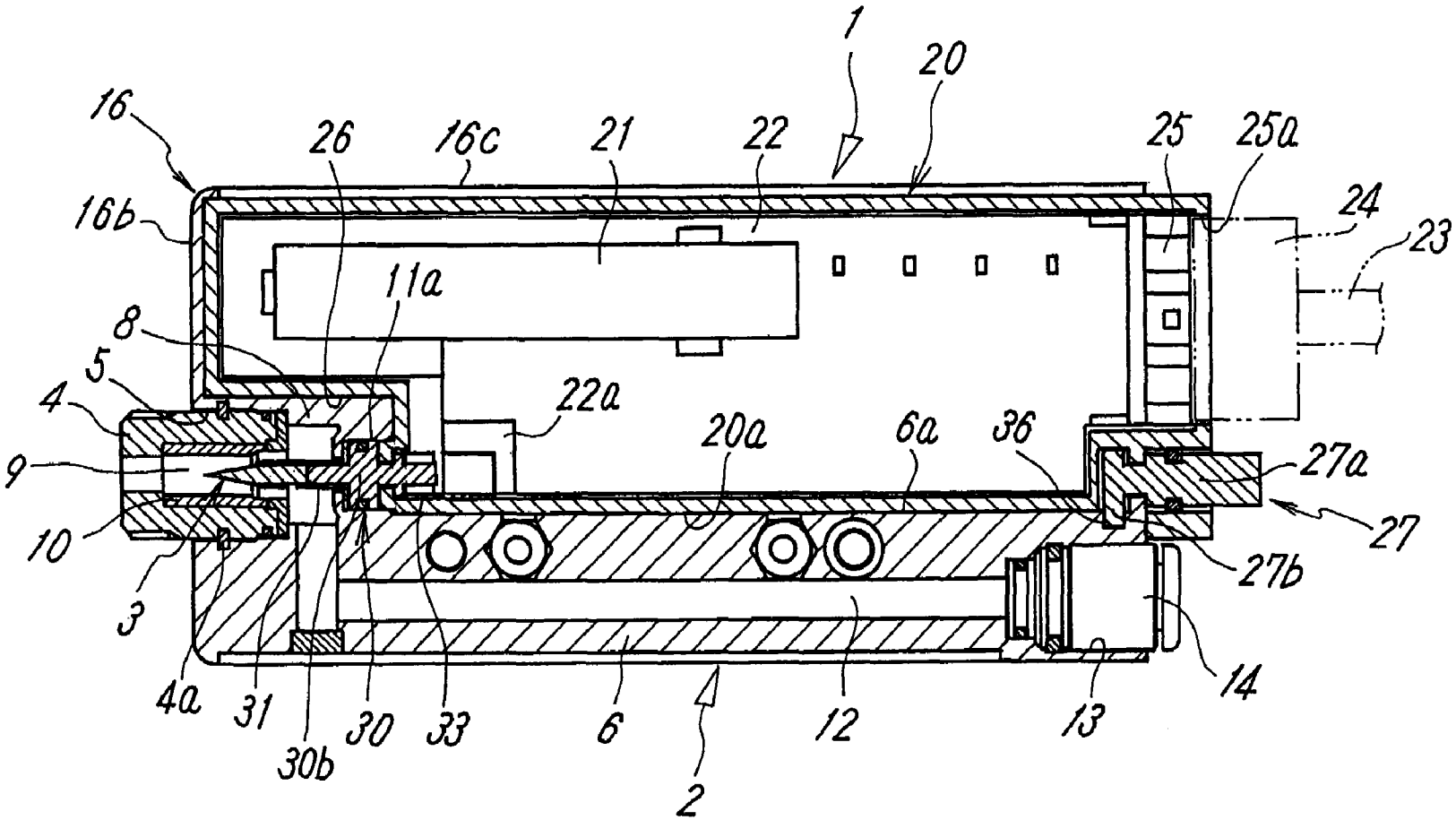
FIG. 3 is a longitudinal side elevation of FIG. 1.
Figure 4:
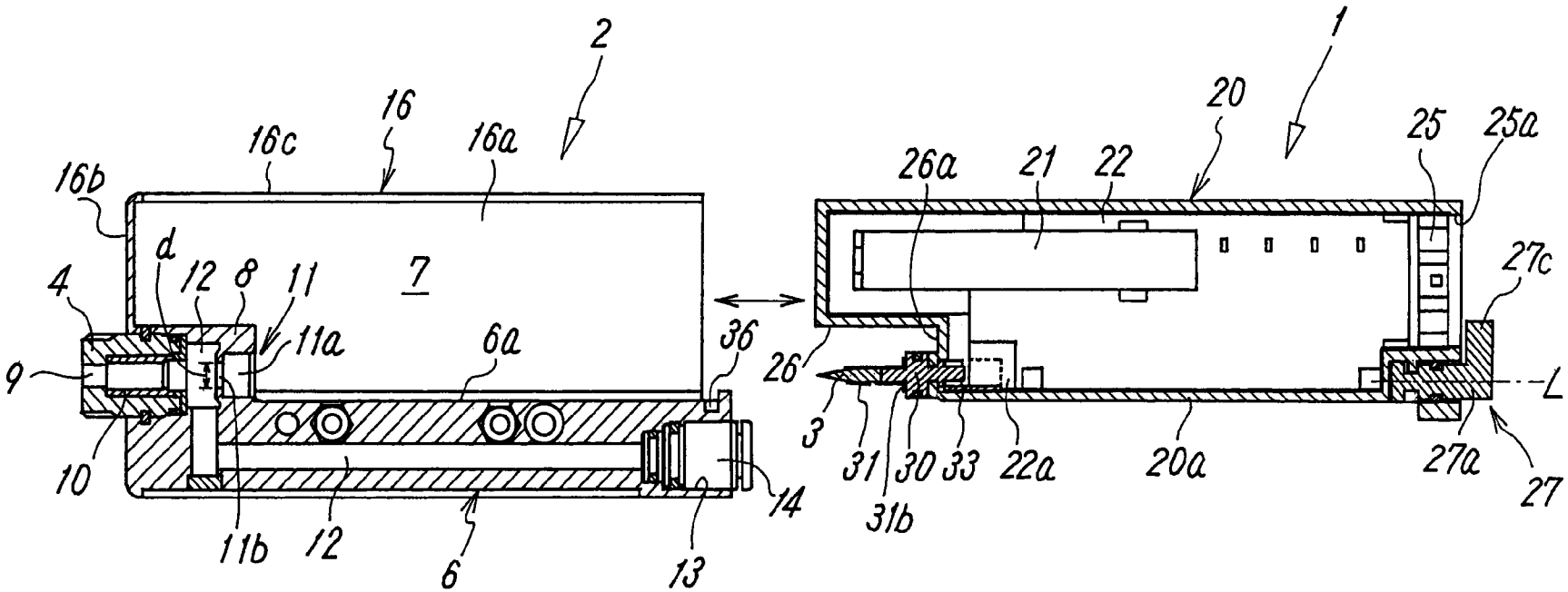
FIG. 4 is a side elevation illustrating a condition where an electrode needle cartridge and a main body block in the ionizer are separated.

The electrode needle cartridge 1 is, as is clear from FIG. 3 and FIG. 4, constructed by providing the electrode needle 3, a high voltage generating device 21 for applying high voltage to the electrode needle 3, a printed circuit board 22 where the high voltage generating device 21 is attached, and a receiving connector 25 for connecting a feeding connector 24 attached to the power cable 23 to a housing 20 made of an electrical insulation material such as synthetic resin or the like.

The housing 20 is formed into a box shape of a substantially rectangular or a similar cross-sectional shape, and is formed by joining two of left and right dish-shaped housing members confronting each other. The housing 20 has a length in a front-and-back direction approximating to the length in the front-and-back direction of the main body block 2, and a height approximating to a height of the cartridge housing portion 7. At a lower surface of a tip end portion of the housing 20, a concave step portion 26, which is fitting to and in contact with the convex step portion 8 of the main body block 2 each other, is formed. Each of the heights of the convex step portion 8 and the concave step portion 26 is approximately the same, and the lengths in the front-and-back direction are approximately the same. Further, a lower surface 20*a* of the housing 20 is, including a lower surface of the concave step portion 26, formed into a substantially flat surface without having an asperity in the front-and-back direction of the housing 20, except a portion where a locking member 27, described later, is attached.

In the housing 20, at a step wall 26*a* in a longitudinal direction of the concave step portion 26, the electrode needle 3 is detachably attached via a feeding terminal 30 and an electrode needle holder 31.

The feeding terminal 30 is made of a conductive material such as metal or the like. Further, as is clear from FIG. 5 and FIG. 6, the feeding terminal 30 includes an electrode needle attaching shaft portion 30*a* having a column-shape and preferably, a cylindrical shape, a circular disk portion 30*b* for use in sealing where an O-ring 32 is attached on an outer periphery thereof, a fitting shaft portion 30*c* fitting in an attaching hole 26*b* of the step wall 26*a* of the housing 20, a flange-shaped hooking portion 30*d*, which is in contact with and hooked on an inner surface of the housing 20, and a connecting shaft portion 30*e* to be connected with the high voltage generating device 21 in an integral manner from a tip end side of the feeding terminal 30 in turn. The feeding terminal 30 is electrically connected to a terminal connecting portion 22*a* on the printed circuit board 22 via a clip-type feeding plate 33 attached to the connecting shaft portion 30*e*. The feeding plate 33 is formed into approximately U-shape in cross-section from a metal sheet having elasticity, and is elastically attached to the connecting shaft portion 30*e* and the terminal connecting portion 22*a* in a sandwiching manner.

Thus, when the feeding terminal 30 is attached to the housing 20, the circular disk portion 30*b* is positioned in front of an outer part of the step wall 26*a*, and the electrode needle attaching shaft portion 30*a* extends out frontward from a center of a front surface of the circular disk portion 30*b* in a concentric manner relative to the disk portion 30*b*.

The attaching hole 26*b* is formed by confronting half holes formed in the housing members each other, at a commissure of the left and right housing members in the housing 20. At this moment, the fitting shaft portion 30*c* is attached inside the attaching hole 26*b* by fitting and sandwiching the fitting shaft portion 30*c* between the half holes.

Further, the electrode needle holder 31 is a cylindrical member formed from a material having conductivity and elasticity, such as metal or the like. The electrode needle holder 31 includes a gradually tapered circular conic retaining portion 31*a* at a tip end thereof, a flange-shaped contacting portion 31*b* overhanging in an outer peripheral direction at a rear end thereof, and a slit extending in an axis direction of the electrode needle holder 31 at a side face thereof. A diameter of the electrode needle holder 31 is configured to be elastically and automatically adjusted corresponding to diameters of the electrode needle 3 and the electrode needle attaching shaft portion 30*a* of the feeding terminal 30 by means of the slit. A diameter D of the contacting portion 31*b* is formed to be greater than a bore diameter d of the small-diameter portion 11*b* of the main body block 2.

On the other hand, the electrode needle 3 includes a main body portion 3*a* having a circular cylinder shape, which is closely fitting to, and electrically in contact with the electrode needle holder 31, and a gradually tapered circular conic tip end portion 3*b*. The electrode needle 3 is inserted into the electrode needle holder 31 from a rear end portion side, and the tip end portion 3*b* is hooked on the retaining portion 31*a* of the electrode needle holder 31. Thereby, the electrode needle 3 is detachably held by the electrode needle holder 31 in a condition so that the electrode needle 31 is prevented from being pulled out forward.

Further, the electrode needle holder 31 holding the electrode needle 3 is fitted into the attaching shaft portion 30*a* up to a position where the contacting portion 31*b* becomes in contact with the circular disk portion 30*b*. Thereby, the electrode needle 3 is attached to the feeding terminal 30 via the electrode needle holder 31. In this case, it is preferable that the electrode needle 3 is positioned within an area of the concave step portion 26, and that the tip end portion 3*b* is not protruded forward from the housing 20.

By this construction, when the lower surface 20*a* of the housing 20 of the electrode needle cartridge 1 is in contact with the upper surface 6*a* of the base portion 6 of the main body block 2 and when the electrode needle cartridge 1 is slid forward and connected to the main block 2, as indicated by an arrow in FIG. 4, the electrode needle 3 is inserted into inside the nozzle 4 from the electrode needle inserting entrance 11, and the tip end portion 3*b* of the electrode needle 3 is brought to be positioned inside the air-blowing outlet 9, specifically inside the sleeve 10. At this moment, the circular disk portion 30*b* is fitted into the large-diameter portion 11*a* of the electrode needle inserting entrance 11, and the O-ring 32 seals a space between an outer periphery of the circular disk portion 30*b* and an inner periphery of the large-diameter portion 11*a*.

Further, the contacting portion 31*b* of the electrode needle holder 31 is in contact with a mouth edge of the small-diameter portion 11*b* and hooked thereto. In addition, the contacting portion 31*b* is sandwiched between the mouth edge and the circular disk portion 30*b*, and thereby the electrode needle holder 31 is prevented from moving to a nozzle 4 side while passing through the small-diameter portion 11*b*.

When the maintenance for the electrode needle 3 is performed, the electrode needle cartridge 1 is slid backward along the upper surface 6*a* of the base portion 6 and is removed from the main body block 2. The electrode needle 3 is thereby taken out backward from the nozzle 4. Therefore, a removal operation for the stain on the electrode needle 3, exchanging operation for the electrode needle 3, or the like can be performed.

The high voltage generating device 21 is mounted on the printed circuit board 22 where a printed wiring operation is performed, and is provided in an inside of the housing 20 via the printed circuit board 22. Further, at a rear end portion of the housing 20, the receiving connector 25 is attached while a connecting port 25*a* thereof is faced to a backside of the housing 20, and is connected to the high voltage generating device 21 via the printed wiring on the printed circuit board 22.

Further, at the rear end portion of the housing 20 of the electrode needle cartridge 1, the locking member 27 for locking the electrode needle cartridge 1 and the main body block 2 in a connected condition is provided. The locking member 27 includes a main shaft portion 27*a* supported so as to be rotatable around an axis line L, as a center, in a front-and-back direction in the housing 20, a hooking portion 27*b* formed at a tip end of the main shaft portion 27*a* so as to protrude sideward of the main shaft portion 27*a*, and hooked or unhooked on a hooking hole 36 of the main body block 2 by forward-and reverse rotation of the main shaft portion 27*a*, and a handle portion 27*c*, which is formed at a rear end portion of the main shaft portion 27*a* in a manner so as to be protruded sideward while keeping an angle difference at 90 degrees around the axis line L relative to the hooking portion 27*b*, for performing a rotating operation for the main shaft portion 27*a*. The locking member 27 is disposed at a position in the vicinity of the receiving connector 25.

Figure 7:
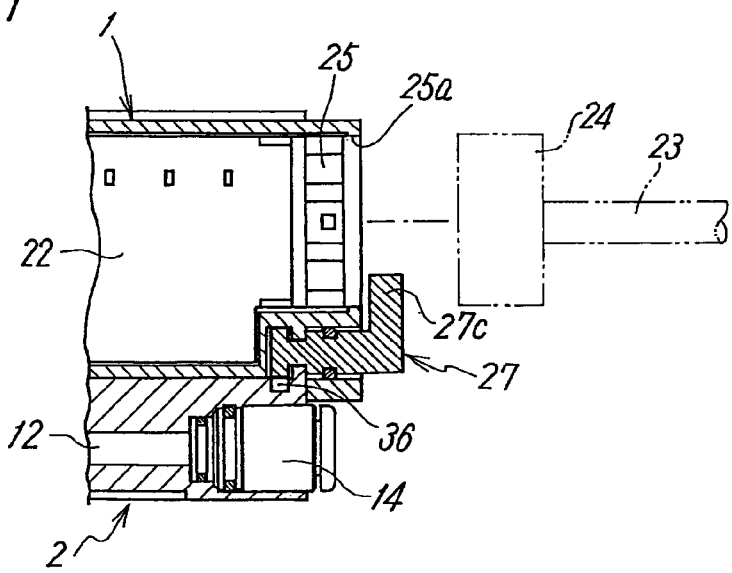
FIG. 7 is an enlarged cross-sectional view of a main part in FIG. 1, and is a view illustrating an operating condition different from that of FIG. 3.
Figure 8:
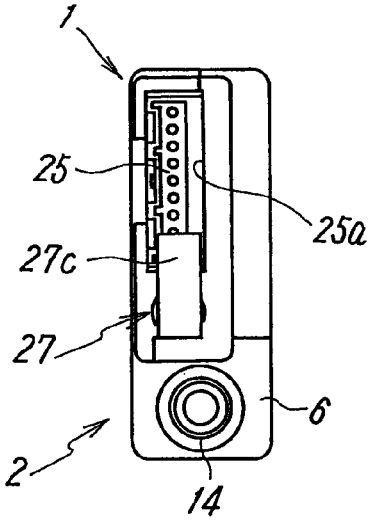
FIG. 8 is a rear side elevation of the ionizer, and is a view illustrating an operating condition different from that of FIG. 2.
Figure 9:
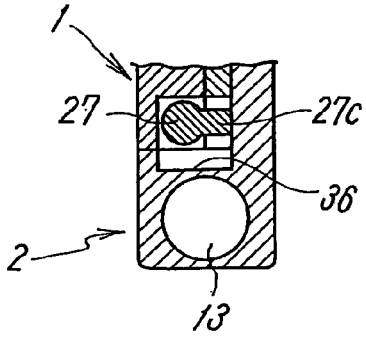
FIG. 9 is a cross-sectional view of a main part illustrating an internal structure in the operating condition of FIG. 8.
Figure 10:
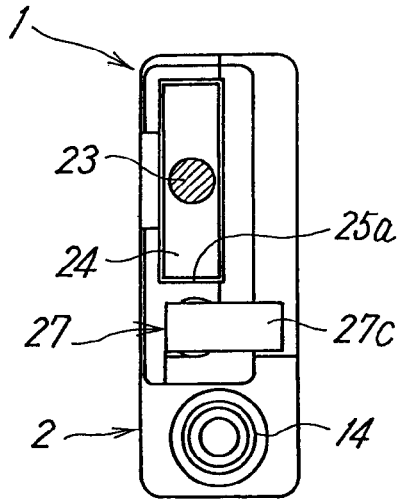
FIG. 10 is a rear side elevation illustrating the ionizer in a condition where a feeding connector is connected.
Figure 11:
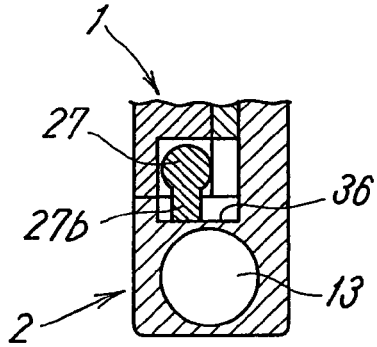
FIG. 11 is a cross-sectional view of a main part illustrating an internal structure in the operating condition of FIG. 10.

Furthermore, as illustrated in FIG. 3 and FIG. 11, in a locking condition where the hooking portion 27*b* is hooked on the hooking hole 36, the handle portion 27*c* is horizontally positioned beneath the connecting port 25*a* of the receiving connector 25 and occupies a locking position where the handle portion 27*c* is retracted from the connecting port 25*a* as illustrated in FIG. 10, and in a condition where the hooking portion 27*b* is tripped from the hooking hole 36, and the locking operation is released, as illustrated in FIG. 7 and FIG. 9, the handle portion 27*c* is located in front of the connecting port 25*a* of the receiving connector 25 and configured to occupy a locking operation releasing position where the handle portion 27*c* covers part of the connecting port 25*a*, as illustrated in FIG. 7 and FIG. 8. Accordingly, when the handle portion 27*c* is located at the locking position, the feeding connector 24 can freely be attached to or detached from the receiving connector 25. When the handle portion 27*c* is located at the locking operation releasing position, the feeding connector 24 cannot be connected to the receiving connector 25.

In other words, in a case that the electrode needle cartridge 1 is removed from the main body block 2 when the maintenance for the electrode needle 3 is performed, the handle portion 27*c* located at the locking position cannot be rotated to the locking operation releasing position. This is because, when the feeding connector 24 is connected to the receiving connector 25, namely in a condition that the high voltage generating device 21 is connected to a power source, a rotating operation of the handle portion 27*c* is limited by the feeding connector 24. Thereby, a risk such as that the electrode needle cartridge 1 is removed without turning off the power distribution for the electrode needle 3 is avoided and high safety is secured.

However, when the feeding connector 24 is removed from the receiving connector 25, the handle portion 27*c* can be rotated toward the locking operation releasing position, therefore the maintenance for the electrode needle 3 can safely be performed while removing the electrode needle cartridge 1.

The ionizer having the construction is used by connecting the feeding connector 24 of the power cable 23 to the receiving connector 25, and by connecting an air piping tube to the connecting port 13 for use in piping. When the ionizer is used, the locking member 27 locks the main body block 2 and the electrode needle cartridge 1 in a connected condition while the handle portion 27*c* occupies the locking position as illustrated in FIG. 10, and the hooking portion 27*b* is hooked on the hooking hole 36 of the main body block 2.

When the power source is turned on in the condition, the AC high voltage is applied from the high voltage generating device 21 to the electrode needle 3, the electrode needle 3 generates a corona discharge and positive and negative ions are alternately generated.

On the other hand, air is supplied to the nozzle 4 through the air passing-through hole 12, and the air is blown out from the air-blowing outlet 9. However, the air takes in the ion generated from the electrode needle 3 resulting in becoming ionized air. The ionized air is blown out toward a workpiece in this condition.

Figure 5:
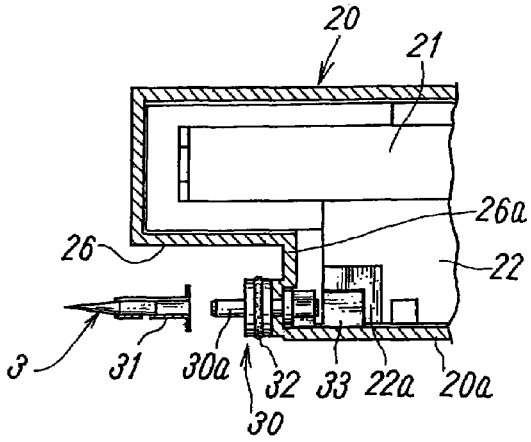
FIG. 5 is a partial side elevation illustrating the electrode needle cartridge in a condition where an electrode needle is detached.
Figure 6:
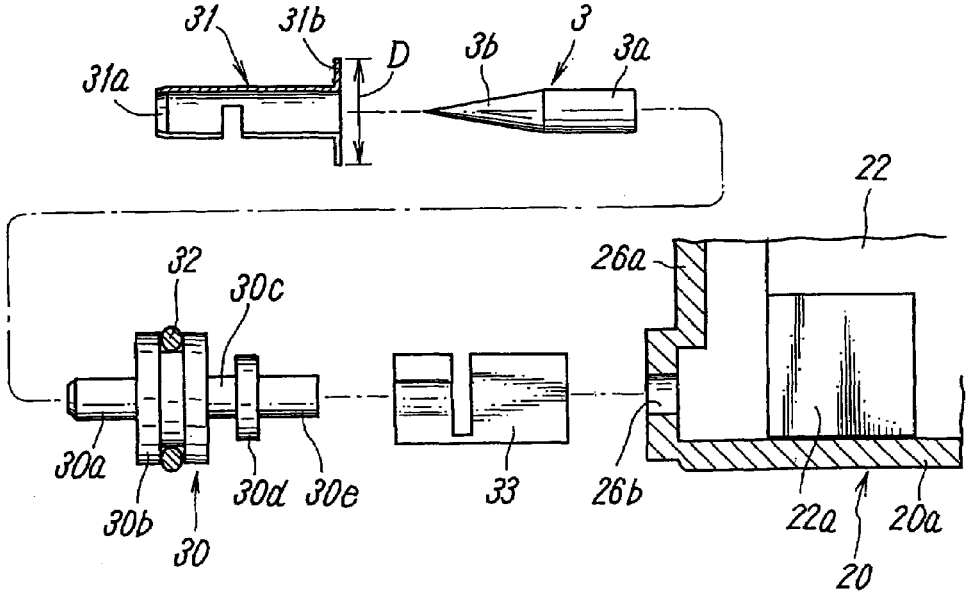
FIG. 6 is a partial side elevation illustrating the electrode needle cartridge where parts relating to an attaching operation for the electrode needle are shown, while dismantling the same.

When a need for the maintenance occurs when the electrode needle 3 gets stained, the locking operation is released by rotating the handle portion 27*c* of the locking member 27 in the locking operation releasing position after removing the feeding connector 24 from the receiving connector 25, as illustrated in FIG. 7. Further, the electrode needle cartridge 1 is slid backward, and is removed from the main body block 2, as illustrated in FIG. 4, and a cleaning operation or an exchanging operation for the electrode needle 3 is performed. In a case that the electrode needle 3 is removed for performing the cleaning operation or the exchanging operation therefor, it is sufficient that the electrode needle holder 31 is taken out from the electrode needle attaching shaft portion 30*a* of the feeding terminal 30, and the electrode needle 3 is taken out from the electrode needle holder 31, as illustrated in FIG. 5 and FIG. 6.

In this case, the attaching and detaching operations for the electrode needle 3, or the attaching and detaching operations for the electrode needle attaching shaft portion 30*a* are easy because the electrode needle holder 31 is provided with elasticity and is provided with the slit in an axis direction.

Thus, in the ionizer having the construction, the electrode needle cartridge 1 is provided with the electrode needle 3, the high voltage generating device 21, and the receiving connector 25, and the main body block 2 is provided with the air-blowing outlet 9, the air passing-through hole 12, and the connecting port 13. Thereby, the electricity-relating parts and portions, and the air-relating parts and portions can rationally be distributed into separate members, and supported. As a result, an entire construction can be simplified and at the same time, the attaching and detaching operations for the electrode needle cartridge 1 and the main body block 2 can simply and safely be performed. In addition, since the separating operation for the electrode needle cartridge 1 and the main body block 2 can safely be performed by means of the locking member 27, safety of the maintenance for the electrode needle 3 is also excellent.

Incidentally, although the ionizer in the embodiment is an ionizer of an alternating current (AC) type, the present invention can also be applied to an ionizer of a direct current (DC) type. In this case, two of positive and negative electrode needles 3 are held in the electrode needle cartridge 1, and the electrode needles 3 are housed in the air-blowing outlet 9 of the main body block 2.

Figure 12:
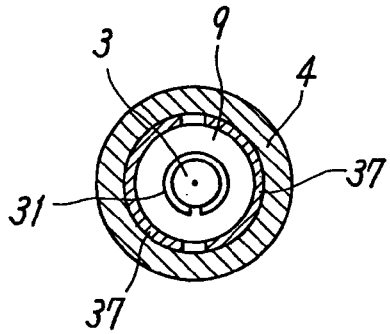
FIG. 12 is a cross-sectional view illustrating another construction example of a nozzle.

Further, in the embodiment illustrated, the nozzle 4 is provided with conductivity and the nozzle 4 serves as the ground electrode. However, the nozzle 4 may be formed with a non-conductive material such as synthetic resin or the like, and the ground electrode may separately be provided. For example, as illustrated in FIG. 12, a ground electrode 37 having conductivity may be held by the circular cylinder-shaped nozzle 4 made of synthetic resin. In this case, although the ground electrode 37 is preferable to have a circular cylinder shape, the cross-section of the ground electrode 37 is not always necessary to be a complete circular shape. Namely, the ground electrode 37 may have a C-shaped cross-section having a slit in an axis direction at a side surface. Alternatively, as illustrated, a plurality of (for example, two to four in number) ground electrodes 37 each having an arc shape or a shape similar thereto in cross-section may be held while disposing in an approximately cylindrical manner in a condition where a gap intervenes inbetween each other.

Each of the ground electrodes 37 can be attached to an inner periphery, an outer periphery, or in a wall thickness of the nozzle 4. In a case that the ground electrode 37 is attached to the inner periphery of the nozzle 4, as illustrated in FIG. 12, so as to avoid a contact of the ground electrode 37 with the electrode needle 3, an electrical insulation sleeve may be attached along an inner periphery of the ground electrode 37 as needed.

Incidentally, in FIG. 12, a numeral 3 denotes the electrode needle, a numeral 9 denotes the air-blowing outlet, and a numeral 31 denotes the electrode needle holder, respectively.

The invention claimed is:

1. An ionizer constructed by separatably connecting an electrode needle cartridge comprising an electrode needle for generating an ion, and a main body block comprising an air-blowing outlet serving as an electrode needle housing chamber in a condition where the electrode needle is inserted into the air-blowing outlet, and constructed such that the electrode needle is inserted into or removed from the air-blowing outlet, from an electrode needle inserting entrance at a rear end portion side of the air-blowing outlet when the electrode needle cartridge and the main body block are connected or separated, wherein the electrode needle cartridge includes the detachable electrode needle and a high voltage generating device for applying high voltage to the electrode needle, and wherein the main body block includes an air passing-through hole for supplying air to the air-blowing outlet and a connecting port (13) for connecting an air piping to the air passing-through hole.

2. The ionizer according to claim 1, wherein the ionizer is constructed such that the electrode needle cartridge is connected to or separated from the main body block and the electrode needle is inserted into or removed from the air-blowing outlet, by only sliding the electrode needle cartridge in a front-and-back direction without rotating the same.

3. The ionizer according to claim 1, wherein a convex step portion and a concave step portion being in contact with each other when the same are connected are formed at a front end portion of the main body block and a front end portion of the electrode needle cartridge, respectively, and wherein the air-blowing outlet is formed at a position of the convex step portion and the electrode needle is formed at a position of the concave step portion.

4. The ionizer according to claim 3, wherein the main body block includes a base portion provided with the air-blowing outlet, the air passing-through hole, and the connecting port, and a cartridge housing portion for housing the electrode needle cartridge while being positioned on the base portion, and wherein at an upper surface of a tip end portion of the base portion, the convex step portion rising upward is formed, and at a front surface of the convex step portion, the air-blowing outlet is provided, and at a rear surface of the convex step portion, the electrode needle inserting entrance is provided in a concentric manner relative to the air-blowing outlet, and wherein the electrode needle cartridge has a length in a front-and-back direction approximating to the main body block, and includes the concave step portion conforming to the convex step portion at a lower surface of a tip end portion, and wherein the electrode needle is attached to a position of the concave step portion in a condition of extending forward, and wherein the electrode needle cartridge is configured to be attached to and detached from the main body block by sliding in the front-and-back direction along an upper surface of the base portion as a guide.

5. The ionizer according to claim 1, wherein the electrode needle is detachably and elastically held by a conductive electrode needle holder having elasticity, and wherein the electrode needle holder is detachably and elastically attached to a column-shaped feeding terminal protruding outward from a housing of the electrode needle cartridge.

6. The ionizer according to claim 5, wherein the electrode needle inserting entrance is composed of a large diameter portion at an entrance side and a small diameter portion at a rear side, and the electrode needle holder includes a flange-shaped contacting portion at a base end portion, and wherein a diameter of the contacting portion is formed to be greater than a bore diameter of the small diameter portion, and when the electrode needle held by the electrode needle holder is inserted into the air-blowing outlet from the electrode needle inserting entrance, frontward movement of the electrode needle holder is configured to be limited by that the contacting portion is in contact with and hooked on a mouth edge of the small diameter portion.

7. The ionizer according to claim 1, wherein the ionizer includes a locking member for locking the electrode needle cartridge and the main body block in a connected condition, and the locking member is configured to limit an operation for releasing a locking operation in a condition where the high voltage generating device is connected to a power source.

8. The ionizer according to claim 7, wherein the electrode needle cartridge includes a receiving connector for connecting the feeding connector attached to a power cable, and wherein the locking member includes a main shaft portion rotatably supported by the electrode needle cartridge, a hooking portion hooked on and tripped from the main body block by forward-and-reverse rotation of the main shaft portion, and a handle portion for performing a rotating operation for the main shaft portion, and wherein when the feeding connector is connected to the receiving connector, a rotation of the handle portion in a direction where the locking operation is released is configured to be limited by means of the feeding connector by that the handle portion is disposed in a vicinity of the connecting port of the receiving connector.

9. The ionizer according to claim 3, wherein the electrode needle is detachably and elastically held by a conductive electrode needle holder having elasticity, and wherein the electrode needle holder is detachably and elastically attached to a column-shaped feeding terminal protruding outward from a housing of the electrode needle cartridge.

10. The ionizer according to claim 9, wherein the electrode needle inserting entrance is composed of a large diameter portion at an entrance side and a small diameter portion at a rear side, and the electrode needle holder includes a flange-shaped contacting portion at a base end portion, and wherein a diameter of the contacting portion is formed to be greater than a bore diameter of the small diameter portion, and when the electrode needle held by the electrode needle holder is inserted into the air-blowing outlet from the electrode needle inserting entrance, frontward movement of the electrode needle holder is configured to be limited by that the contacting portion is in contact with and hooked on a mouth edge of the small diameter portion.

11. The ionizer according to claim 3, wherein the ionizer includes a locking member for locking the electrode needle cartridge and the main body block in a connected condition, and the locking member is configured to limit an operation for releasing a locking operation in a condition where the high voltage generating device is connected to a power source.

12. The ionizer according to claim 11, wherein the electrode needle cartridge includes a receiving connector for connecting the feeding connector attached to a power cable, and wherein the locking member includes a main shaft portion rotatably supported by the electrode needle cartridge, a hooking portion hooked on and tripped from the main body block by forward-and-reverse rotation of the main shaft portion, and a handle portion for performing a rotating operation for the main shaft portion, and wherein when the feeding connector is connected to the receiving connector, a rotation of the handle portion in a direction where the locking operation is released is configured to be limited by means of the feeding connector by that the handle portion is disposed in a vicinity of the connecting port of the receiving connector.

* * * * *